US007886636B1

(12) United States Patent
Mills

(10) Patent No.: US 7,886,636 B1
(45) Date of Patent: Feb. 15, 2011

(54) OPEN-END RATCHETING WRENCH

(76) Inventor: Douglas J. Mills, 37940 42$^{nd}$ St. East, Palmdale, CA (US) 93552

( * ) Notice: Subject to any disclaimer, the term of this patent is extended or adjusted under 35 U.S.C. 154(b) by 159 days.

(21) Appl. No.: 12/287,563

(22) Filed: Oct. 10, 2008

Related U.S. Application Data

(60) Provisional application No. 61/023,360, filed on Jan. 24, 2008.

(51) Int. Cl.
*B25B 13/12* (2006.01)

(52) U.S. Cl. ..... 81/179; 81/111

(58) Field of Classification Search ..... 81/179, 81/111, 126, 99, 109, 127
See application file for complete search history.

(56) References Cited

U.S. PATENT DOCUMENTS 2,655,064 A * 10/1953 Simon et al. ..... 81/99
3,875,828 A 4/1975 Evans
4,276,790 A 7/1981 Davis
4,324,159 A 4/1982 Wrobbel
4,825,731 A 5/1989 Stojamowski
5,018,412 A 5/1991 Wylie, III
5,282,830 A 2/1994 Reynolds
5,582,082 A 12/1996 Gajo
5,996,445 A 12/1999 Wiens
6,339,978 B1 * 1/2002 Hirse ..... 81/99
7,077,035 B1 7/2006 Huang

* cited by examiner

*Primary Examiner*—D. S Meislin
(74) *Attorney, Agent, or Firm*—Dennis W. Beech

(57) ABSTRACT

The present invention may be used for rotating a polygonal object. A first wrench member may have a handle with two ends with a fixed jaw attached at a first end and with a cavity formed in the fixed jaw and first end. A second wrench member may be a movable jaw with a curved jaw attached to a ratcheting element. The ratcheting element may be slidably positioned in the cavity to position the curved jaw opposite the fixed jaw. The second wrench member may be constrained by the cavity and a cavity insert member to slide in said cavity about the center of an arc. The second wrench member may be spring biased by an elastic compression element to move toward the fixed jaw. A gripping surface of the curved jaw may be structured relative to the center of the arc to cause the curved jaw to be urged toward the fixed jaw when rotating the fixed jaw against an intervening polygonal object, and to cause the movable jaw to ratchet open when the handle is rotated in the opposite direction.

10 Claims, 5 Drawing Sheets

OPEN-END RATCHETING WRENCH

This application claims the benefit of U.S. Provisional Application 61/023,360. Filed Jan. 24, 2008.

BACKGROUND OF THE INVENTION

This invention relates to devices for rotating a polygonal fastener, such as a bolt head, nut or the like. The new device has an open-end wrench structure with a movable jaw, ratchet control apparatus.

Fixed jaw, open-end wrenches known in the art may be limited in use for rotating polygonal fasteners because of a long swing or rotational movement requirement. For example, for a hexagonal headed bolt the wrench arm must be rotated 60 degrees to reposition the wrench on adjacent faces of the bolt head to continue to rotate the bolt. This may prevent use of the wrench in areas with limited space. Also, repositioning the wrench for each stroke may add time and effort to manipulating the fastener. Closed-ring configured wrenches allow smaller swing angles, but may still have to be repositioned, or if a socket-type ratchet, may not be used on hydraulic lines, fuel lines, fasteners with long shafts and the like due to vertical clearance requirements.

There may be various devices and inventions known that have been developed in attempts to produce a strong, compact open-end ratcheting wrench. The general approaches for such devices may include: a wrench with fixed jaws that have a special shape that applies torque in one direction and slips around the fastener in an opposite direction; a wrench with both jaws integral with the handle, having small pawls, rollers or camming components carried around their internal surfaces to allow gripping movement of a fastener in only one direction; and open-end wrenches with one or both jaws unidirectionally relieving to allow ratcheting. The first type of mechanism only allows large rotational or swing angle use, that is, for a hexagonal bolt head the swing angle would be 60 degrees. The second type of wrench may be inherently fragile and complicated to manufacture and assemble.

The third type of open-end ratcheting wrenches, those that use a relieving jaw, may have failed to achieve both adequate strength and a compact profile. Several designs may utilize a movable jaw that may be slidably positioned over a wrench head with an attached fixed jaw and may be fastened by a pin to allow rotation of the movable jaw. This may result in a weak mechanism with a bulky head. Another design that has a movable jaw slidably positioned over a wrench head or handle with curved surfaces for engagement when torquing a fastener is also fastened by a pin positioned in a slot. This design appears to also result in a weak mechanism resulting in breakage of the jaw mechanism as experienced by users.

SUMMARY OF THE INVENTION

The present invention is directed to devices for rotating a polygonal object. A first wrench member may have a handle with two ends with a fixed jaw attached at a first end and with a cavity formed in the fixed jaw and first end. A second wrench member may be a movable jaw with a curved jaw attached to a ratcheting element. The ratcheting element may be slidably positioned in the cavity to position the curved jaw opposite the fixed jaw. The second wrench member may be constrained by the cavity and a cavity insert member to slide in said cavity about the center of an arc. The second wrench member may be spring biased by an elastic compression element to move toward the fixed jaw. A gripping surface of the curved jaw may be structured relative to the center of the arc to cause the curved jaw to be urged toward the fixed jaw when the handle may be moved in a direction to urge the fixed jaw toward the curved jaw when a polygonal object is between the two jaws.

These and other features, aspects and advantages of the present invention will become better understood with reference to the following drawings, description and claims.

DETAILED DESCRIPTION

Figure 1:
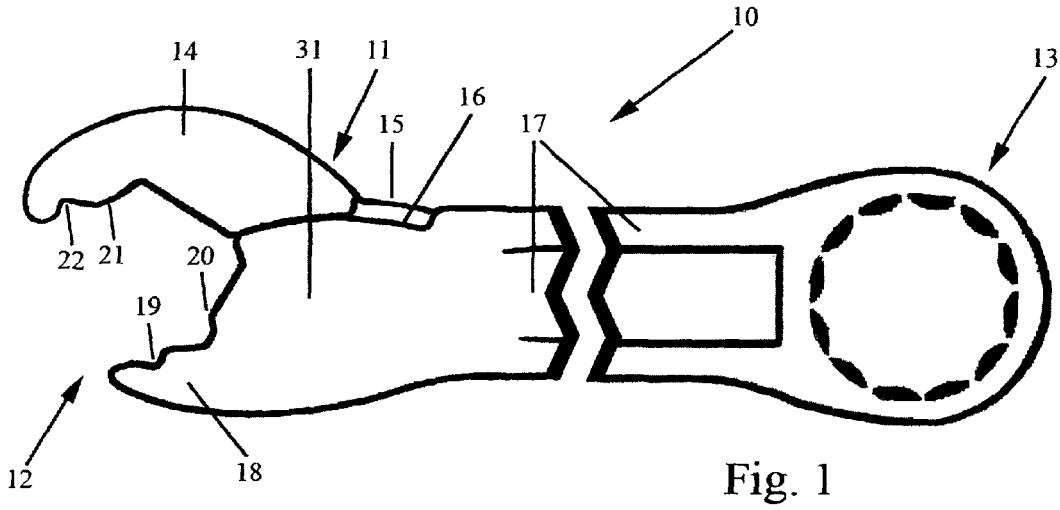
FIG. 1 illustrates a side view of a wrench according to an embodiment of the invention.
Figure 2:
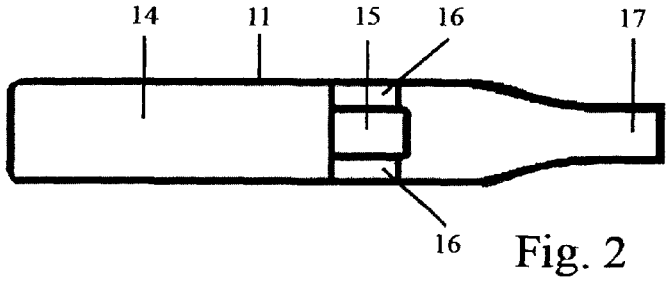
FIG. 2 illustrates a top view of one end of a wrench according to an embodiment of the invention.
Figure 3:
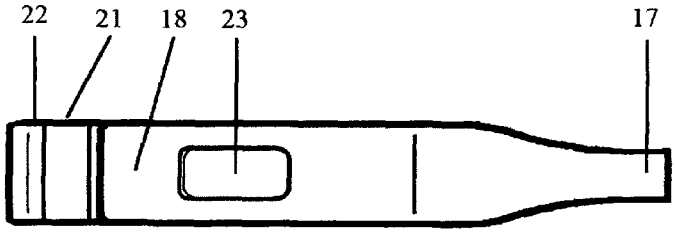
FIG. 3 illustrates a bottom view of one end of a wrench according to an embodiment of the invention.
Figure 4:
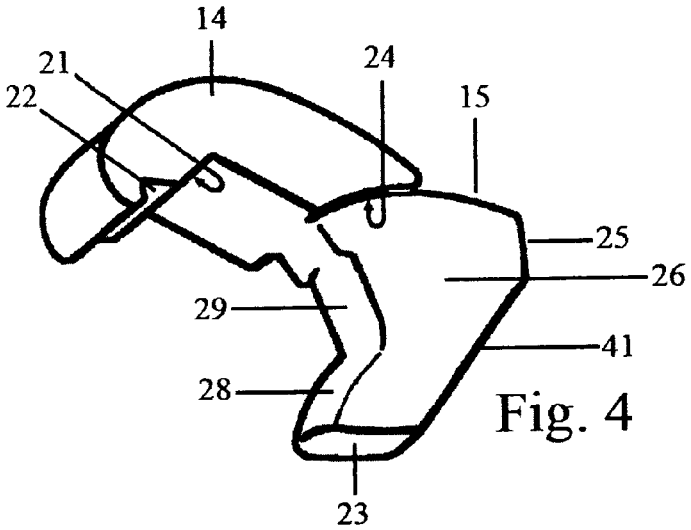
FIG. 4 illustrates a perspective view of a movable jaw according to an embodiment of the invention.
Figure 5:
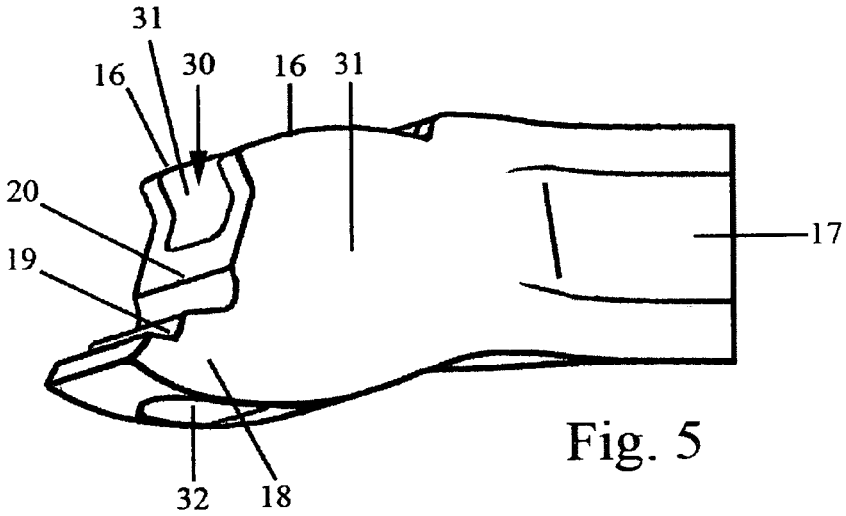
FIG. 5 illustrates a perspective view of a fixed jaw and partial handle according to an embodiment of the invention.
Figure 6:
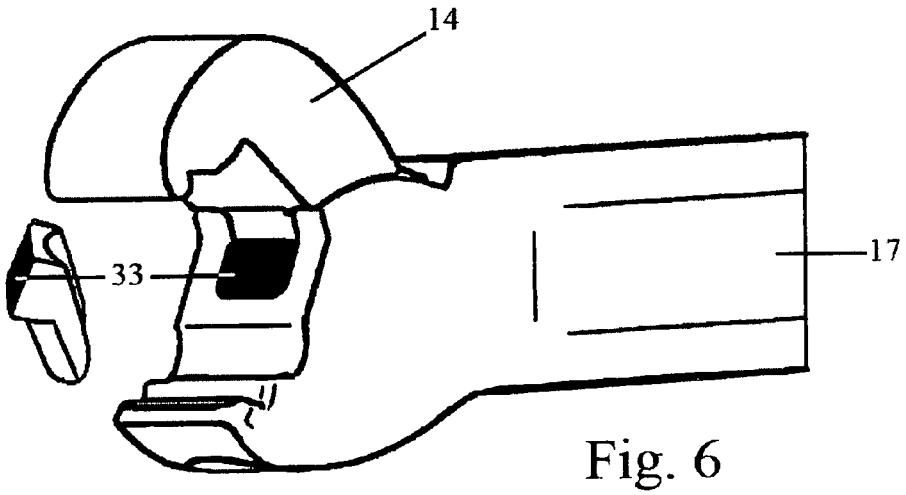
FIG. 6 illustrates a perspective view of a ratcheting member with a wedge removed according to an embodiment of the invention.
Figure 7:
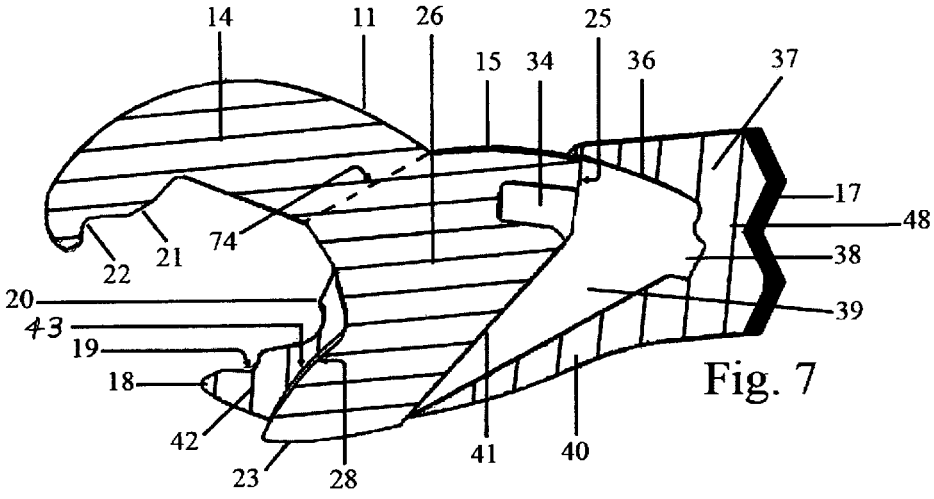
FIG. 7 illustrates a cross-sectional view of a ratcheting member and partial handle according to an embodiment of the invention.
Figure 8:
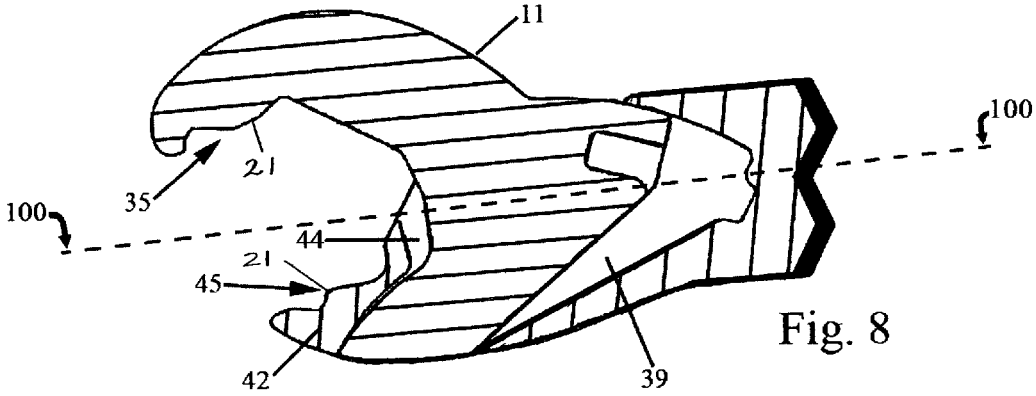
FIG. 8 illustrates a cross-sectional view of a ratcheting member and partial handle according to an embodiment of the invention.
Figure 9:
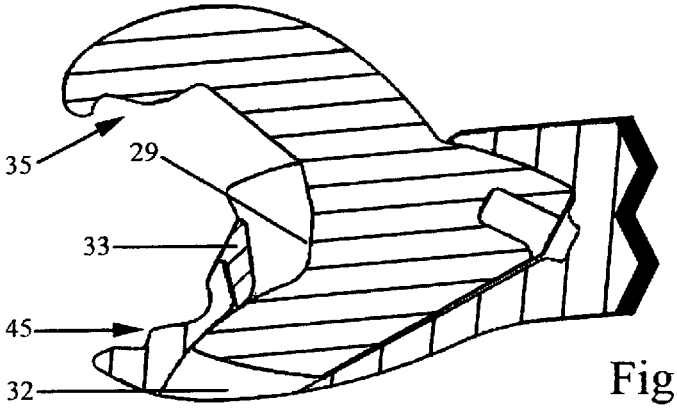
FIG. 9 illustrates a cross-sectional view of a ratcheting member and partial handle with the ratcheting member in a generally open ratcheting position according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 12, a wrench 10 may have a handle 17 with a ratcheting member 12 at one end. The ratcheting member 12 may have a fixed jaw 18 attached to the handle 17 and an opposed movable jaw 11 that may be slidably engaged in a cavity 39 formed in the fixed jaw 18 and handle 17. For purpose of descriptive directional orientation only, the upper portion and lower portion of the wrench 10 as viewed in the Figures, such as FIG. 1, may be referred to as the top and the bottom respectively.

The cavity 39 may be formed of two opposed side walls 31, a forward wall 42 with an exterior gripping surface 45 and an interior concave bearing surface 43, and a rearward wall 48 of a generally "V" shape with a bottom wall portion 40 spaced apart from the forward wall 42 bearing surface 43 to form an opening 32 therebetween and a top wall portion 37 spaced apart from a projection 20 of the forward wall 42 to form a slot 30 therebetween. The top wall portion 37 may have a concave bearing surface 36. The bottom wall portion 40 may have a spring seat 38 formed therein.

The movable jaw 11 may be spring biased toward the forward wall 42. The movable jaw 11 may be an irregular shaped structure with a curved jaw arm 14 attached to a ratcheting element 26. The ratcheting element 26 may have a generally straight rearward edge 41 with a bend portion 25 for positioning a spring pocket 34 to be relatively opposite the spring seat 38. A top edge 15 intersecting the rearward edge 41 may have a convex bearing surface shaped to abut the concave bearing surface 36 of the cavity 39. A forward edge 28 generally opposite and approximately parallel to the rearward edge 41 may have a convex bearing surface shaped to abut the concave bearing surface 43 of the cavity 39. The ratcheting element 26 may have a bottom edge 23 between the rearward edge 41 and the forward edge 28, a wedge abutment edge 29 that intersects the forward edge 28 and is generally orthogonal to the longitudinal centerline 100 of the wrench 10, and an attached portion 74 integral with the curved jaw 14 that intersects the wedge abutment edge 29 and the top edge 15. The curved jaw 14 may be thicker than the ratcheting element 26 which may create a ridge surface 24 at the attached portion 74 which ridge surface 24 may abut the top side edges 16 of the side walls 31 to aid in controlling the rotational motion of the ratcheting element 26.

The various edges and attachment portion 74 define the shape of the ratcheting element 26 that may generally be a flat plate structure that may be slidably positioned in the cavity 39 with the bottom edge 23 adjacent the opening 32 and the top edge 15 partially abutting the concave bearing surface 36. The curved jaw 14 is generally positioned opposed to the fixed jaw 18 when the ratcheting element 26 is positioned in the cavity 39. When positioning the ratcheting element 26 in the cavity 39 a spring 46 may be positioned in the spring pocket 34 and the spring seat 38 to bias the ratcheting element 26 toward forward wall 42. A cavity insert member or wedge 33 may be inserted in the wedge slot 44 and attached, for example, by an epoxy material or other attachment method, to restrict the forward movement of the ratcheting element 26 to prevent the top edge 15 of the ratcheting element 26 from forward movement past the end of the top wall portion 37 of the cavity 39. Such movement may allow the ratcheting element 26 to slide out of the cavity 39.

With the ratcheting element 26 installed in the cavity 39 the fixed jaw 18 with exterior gripping surface 45 that may have at least one notch 19 and boss 21 may be positioned opposed to the gripping surface 35 of the movable jaw 11 that may have at least one notch 22 and boss 21.

Referring to FIGS. 10 through 13, for efficiency of operation of the wrench 10 for gripping polygonal fasteners and ratcheting around them, the structure for a wrench 10 to manipulate a bolt head, nut or the like fastener 47 that has a hexagonal shape is described. The center 57 of circles or concentric arcs 54, 56 may be used to define the shape of the surfaces and edges that abut to support force and ratcheting relative to a hexagonal object such as a nut 47. A first arc 54 of radius 58 may be defined as approximately the length of twice the distance 59 between opposite faces 60 of the nut 47 to be manipulated. The arc 54 should pass through the center of the nut 47. To define a third parameter to locate the center 57, a line 53 passing through the nut 47 center parallel to the opposing nut faces 60 serves as a reference for angular positioning of a tangent line 52 to arc 54 whose normal line 50 passes through the contact point 51 on movable jaw 11. The tangent line 52 should be positioned at an acute angle @ of approximately 15 degrees plus or minus 5 degrees relative to the line 53. With these three parameters the arc center 57 may be located. While the arcs 54, 56 have been described as concentric, the center for each arc 54, 56 may be separated in distance plus or minus one inch.

Figure 10:
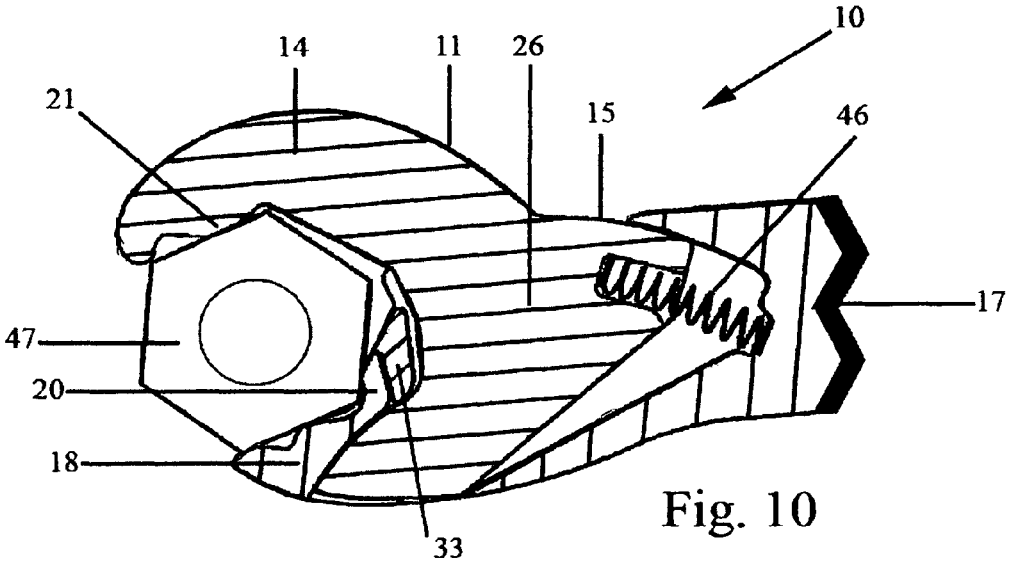
FIG. 10 illustrates a cross-sectional view of a ratcheting member with a polygonal object between the jaws according to an embodiment of the invention.
Figure 11:
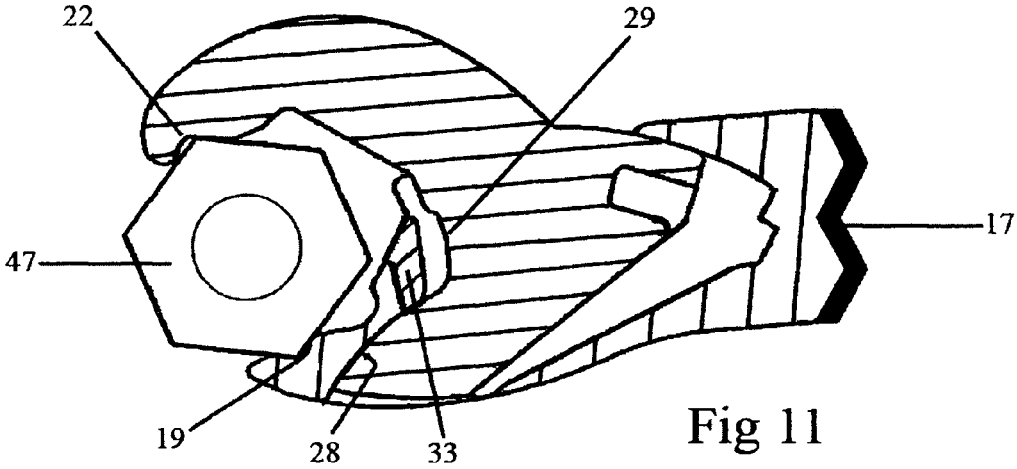
FIG. 11 illustrates a cross-sectional view of a ratcheting member with a polygonal object between the jaws according to an embodiment of the invention.
Figure 12:
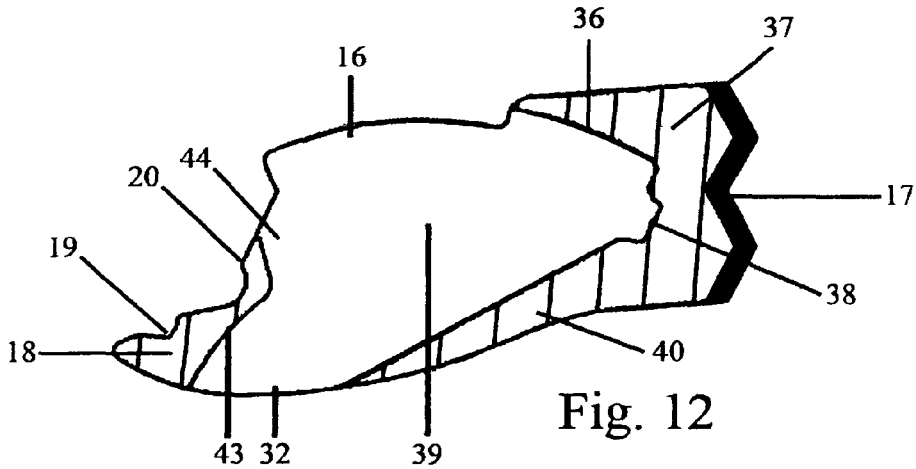
FIG. 12 illustrates a cross-sectional view of a fixed jaw and partial handle according to an embodiment of the invention.
Figure 13:
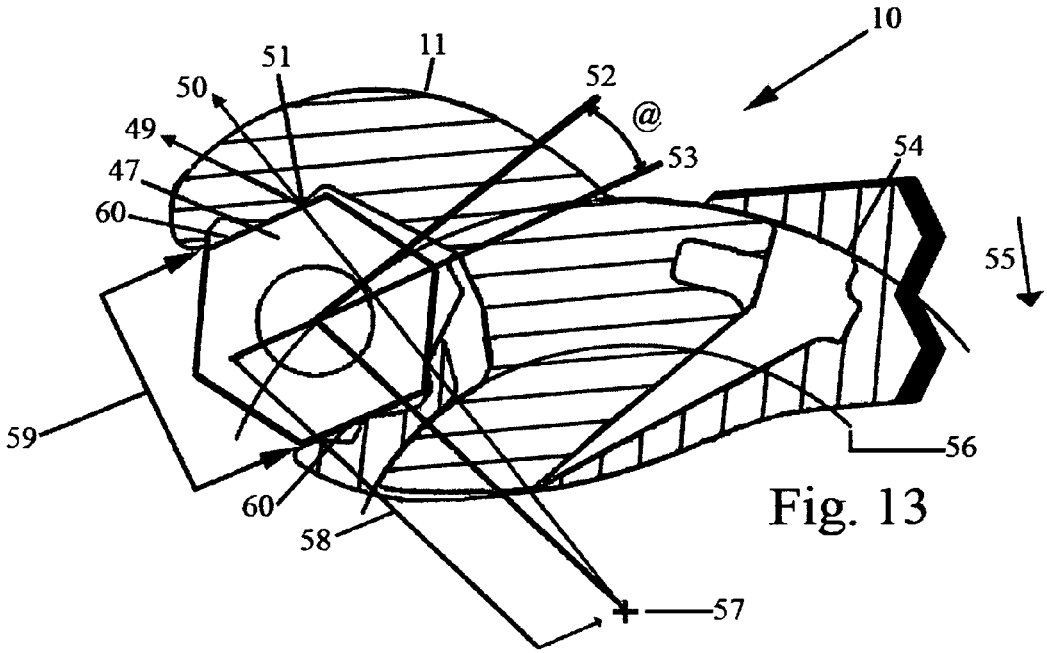
FIG. 13 illustrates a cross-sectional view of a ratcheting member with a polygonal object between the jaws and the geometry related to the rotational sliding movement of the movable jaw relative to a center of rotation according to an embodiment of the invention.

When rotating the wrench 10 to move the fixed jaw 18 toward the curved jaw 14 the spring biased curved jaw 14 may engage a nut 47 at one of the gripping positions as illustrated in FIGS. 10 and 11. As force is applied in the direction of arrow 55, the relatively fixed nut 47 may exert an equal and opposite reaction force at the contact point 51 represented by the direction of arrow 49. Since the angular direction of the reaction force 49 produced by the nut 47 acting on the movable jaw 11 is greater in the direction for closing than the normal line 50 from the center 57 of the arc 54 defining the arc traveled by the movable jaw 11, it results in the tendency of the movable jaw 11 to rotate in the direction of the arrow 49, thereby urging the movable and fixed jaws 11, 18 closer together to clamp the nut 47. With sufficient torque force the wrench 10 may be used to move the nut 47 rotationally in either direction by simply rotating the wrench 10 on its longitudinal axis 180 degrees.

To allow the ratcheting member 12 to slip or ratchet around the nut 47 the wrench 10 may be rotated in the direction opposite the gripping direction 55, that is, to rotate the wrench 10 to move the fixed jaw 18 away from the curved jaw 14. The direction of the reaction force then moves to the opposite side of the normal line 50, forcing the movable jaw 11 to rotate in the direction opposite the gripping direction 55 thereby compressing the bias spring 46 and allowing the movable jaw 11 to relieve away from the fixed jaw 18 to slide over the corners of the nut 47.

The arc 54 described above and a concentric arc 56 defines the curves of the bearing surfaces that abut between the cavity 39 and movable jaw 11. The concave bearing surface 43 that abuts the forward edge 28 has a surface along arc 56 and the concave bearing surface 36 that abuts the top edge 15 has a surface along arc 54. These bearing surfaces transfer the force applied to the handle 17 to urge the fixed jaw 18 and curved jaw 14 toward one another. These surface structures allow a simple rotational motion along the curve of the bearing arcs 54, 56 without the need for a pin or other structural member to control the rotation and force transference. This may allow for a more durable wrench and for ease of manufacture.

Referring to FIG. 1, the wrench 10 may have a fixed member 13, for example, a box wrench element, attached to the handle 17 end opposite the ratcheting member 12.

While the invention has been particularly shown and described with respect to the illustrated embodiments thereof, it will be understood by those skilled in the art that the foregoing and other changes in form and details may be made therein without departing from the spirit and scope of the invention.

I claim:

1. A wrench for rotating a polygonal object comprising:

a first wrench member comprising a handle having a first end and a second end with a fixed jaw attached at said first end and a cavity formed in said fixed jaw and said first end;

a second wrench member comprising a movable jaw with a curved jaw attached to a ratcheting element wherein said ratcheting element is slidably disposed in said cavity to position said curved jaw opposed to said fixed jaw;

said second wrench member is constrained by said ratcheting element disposed in said cavity that has a plurality of bearing surfaces and a cavity insert member for said ratcheting element to slide in said cavity about the center of an arc defined by the shape of said bearing surfaces and said cavity insert member, and said second wrench member is biased by an elastic compression element to move toward said fixed jaw; and a first gripping surface of said curved jaw is structured relative to the center of said arc to cause said curved jaw to be urged toward said fixed jaw when said handle is moved in a direction to urge said fixed jaw toward said curved jaw when a polygonal object is between said fixed jaw and said curved jaw.

2. The wrench as in claim 1 wherein said cavity comprising:

two opposed spaced apart side walls of said fixed jaw;

a forward wall with an exterior gripping surface and a first interior concave bearing surface;

a rearward wall with a bottom wall portion spaced apart from said forward wall to define an opening therebetween;

a top wall portion of said rearward wall spaced apart from a forward wall projection to define a slot therebetween and said top wall portion having a second interior concave bearing surface; and said rearward wall having an elastic compression member seat therein in said bottom wall portion.

3. The wrench as in claim 2 wherein said ratcheting element comprising:

a generally flat irregular shaped plate with a rearward edge with a bend portion having an elastic compression member pocket therein;

a top edge extending from said rearward edge with said top edge having a first convex bearing surface shaped to abut said second concave bearing surface;

a bottom edge extending from said rearward edge with a forward edge extending from said bottom edge approximately parallel to said rearward edge and said forward edge having a second convex bearing surface shaped to abut said first concave bearing surface; and a wedge abutment edge extending from said forward edge to intersect an attachment portion of said ratcheting element to which said curved jaw is attached.

4. The wrench as in claim 1 wherein said fixed jaw has a second gripping surface with at least one notch formed therein and said first gripping surface of said curved jaw has at least one notch formed therein.

5. The wrench as in claim 4 wherein said first gripping surface has at least one boss formed therein.

6. The device as in claim 1 wherein said elastic compression element is a spring.

7. The device as in claim 1 wherein said cavity insert member is a wedge attached in a wedge slot of said fixed jaw.

8. The device as in claim 3 wherein the center of a first concentric arc and a second concentric arc is determined by:

a radius of said first concentric arc that has a length approximately twice the distance between two opposite faces of a polygonal object wherein said first arc passes through the center of said polygonal object;

a line passing through said center of said polygonal object parallel to said two opposite faces wherein said line is a reference for angular positioning of a tangent to said first concentric arc whose normal line passes through a contact point for said polygonal object on said movable jaw; and said tangent line is positioned at an acute angle of approximately 15 degrees plus or minus 5 degrees relative to said line.

9. The device as in claim 8 wherein a first arc and a second arc are approximately concentric with a first arc center and a second arc center separated in distance between plus or minus one inch.

10. The device as in claim 8 wherein:

said top edge and said second concave bearing surface are approximately aligned with said first concentric arc; and said forward edge and said first concave bearing surface are approximately aligned with said second concentric arc.

* * * * *